US005797591A

United States Patent [19]

Krage

[11] Patent Number: 5,797,591

[45] Date of Patent: Aug. 25, 1998

[54] GUARDRAIL WITH IMPROVED GROUND ANCHOR ASSEMBLY

[75] Inventor: William G. Krage, Fair Oaks, Calif.

[73] Assignee: Energy Absorption Systems, Inc., Chicago, Ill.

[21] Appl. No.: 846,123

[22] Filed: Apr. 25, 1997

[51] Int. Cl.[6] ..... E01F 15/00

[52] U.S. Cl. ..... 256/13.1; 256/1; 404/6

[58] Field of Search ..... 256/13.1, 1, 19; 404/6, 9, 10

[56] References Cited

U.S. PATENT DOCUMENTS

| | | | |
|---|---|---|---|
| 1,718,876 | 6/1929 | Ramsey | 256/13.1 |
| 3,210,051 | 10/1965 | Case | 256/13.1 |
| 3,512,758 | 5/1970 | Thomas | 256/13.1 |
| 4,655,434 | 4/1987 | Bronstad | 256/13.1 |
| 4,678,166 | 7/1987 | Bronstad et al. | 256/13.1 |
| 4,784,515 | 11/1988 | Krage et al. | 256/13.1 X |
| 4,838,523 | 6/1989 | Humble et al. | 256/13.1 |
| 4,909,661 | 3/1990 | Ivey | 256/13.1 X |
| 5,022,782 | 6/1991 | Gertz et al. . | |
| 5,078,366 | 1/1992 | Sicking et al. | 256/13.1 |
| 5,391,016 | 2/1995 | Ivey et al. | 256/13.1 X |

FOREIGN PATENT DOCUMENTS

| | | | |
|---|---|---|---|
| 94847 | 11/1983 | European Pat. Off. | 256/24 |

OTHER PUBLICATIONS

"Development of a Metal Cutting W–Beam Guardrail Terminal", Brian G. Pfeifer et al., Transportation Research Report TRP–03–43–94, p. 5 (Sep. 1994).

"Steel–Post Breakaway Cable Terminal", Drawing SEW 04a–b, Sheet 7 of 8, (Mar. 1997).

"Modified Eccentric Loader Breakaway Cable Terminal", Drawing SEW05, Sheet 3 of 6 (Mar. 1997).

"Breakemaster® System", Drawing SEW06, Sheet 1 of 2 (Mar. 1997).

"ET–2000 Guardrail Extruder Terminal", Drawing SEW07, Sheet 1 of 2 (Mar. 1997).

"C–A–T Crash–Cushion/Attenuating Terminal", Drawing SEW08, Sheet 1 of 2 (Mar. 1997).

"Slotted Rail Terminal (SRT–100)", Drawing SEW12, Sheet 1 or 2 (Mar. 1997).

*Primary Examiner*—Harry C. Kim

*Attorney, Agent, or Firm*—Brinks Hofer Gilson & Lione

[57] ABSTRACT

A ground anchor assembly for a highway guardrail includes first and second spaced ground anchors and a connecting element interconnected between the anchors. An anchor cable included in the guardrail assembly is connected to the ground anchor assembly adjacent the first ground anchor, and the second ground anchor is situated farther from the central portion of the guardrail assembly than the first ground anchor. In this way improved pull out resistance is provided.

13 Claims, 6 Drawing Sheets

GUARDRAIL WITH IMPROVED GROUND ANCHOR ASSEMBLY

BACKGROUND OF THE INVENTION

This invention relates to a guardrail of the type suitable for use alongside a roadway, and in particular to an improved ground anchor for such a guardrail.

Guardrails are conventionally placed alongside a roadway to redirect a vehicle which has left the roadway. In particular, when a vehicle strikes a guardrail at an oblique angle (such as 20 degrees) the guardrail is designed to prevent the vehicle from passing through the guardrail and to redirect the vehicle along a line more nearly parallel with the roadway. The guardrail requires considerable tensile strength to perform this function. In particular, it is important that the end of the guardrail remain secured properly in place in order that the end can provide an adequate reaction force against the tensile forces associated with an oblique-angle impact.

In the event a vehicle impacts the nose of the guardrail axially, it is important that the guardrail collapse without imposing excessive decelerating or spearing forces on the vehicle. For this reason, conventional guardrails often include mechanisms for disengaging the guardrail from several of the forward posts in order to weaken the end terminal. Because of these mechanisms, the front anchor carries a larger share of applied loads in the event of a glancing impact.

One effective solution to this problem is described in U.S. Pat. No. 5,022,782, assigned to the assignee of this invention. In the disclosed system an anchor cable 122 is secured in place to a poured concrete foundation at the nose of the guardrail assembly, as shown for example in FIG. 2A.

Another prior-art approach is to secure a guardrail anchor cable at the front end of the guardrail to a breakaway wooden post which is in turn set into an anchor tube that is driven into the ground. FIG. 9 shows one prior-art system in which the anchor tube T1 that is secured to the cable C is connected by a yoke Y to a rearward anchor tube T2. In FIG. 9 the forward end of the guardrail G is shown at the left, and the anticipated direction of impact is indicated by the arrow. This prior-art approach attempts to distribute the impact-related tensile loads into the ground more evenly by joining anchor tube T1 to tube T2 by means of the yoke Y.

One problem which has been experienced with the prior art system of FIG. 9 is shown schematically in FIG. 10. In less than ideal soil conditions, for example when the soil is weak or saturated, excessive tension on the cable C can pull the forward tube T1 out of the ground, without substantially moving the rearward tube T2. The yoke Y operates in compression, and typically has a relatively large cross-sectional dimension to prevent premature buckling.

SUMMARY OF THE INVENTION

It is an object of this invention to provide an improved ground anchor assembly that is less subject to unintended extraction from weak or saturated soil.

The invention itself is defined by the following claims. Without intending in any way to limit the scope of these claims, it can be said that the preferred embodiments described below provide an improved geometry for a ground anchor assembly that is less subject to unintended extraction, and that provides a particularly low profile in the preferred embodiment.

DETAILED DESCRIPTION OF THE PRESENTLY PREFERRED EMBODIMENTS

Figure 1:
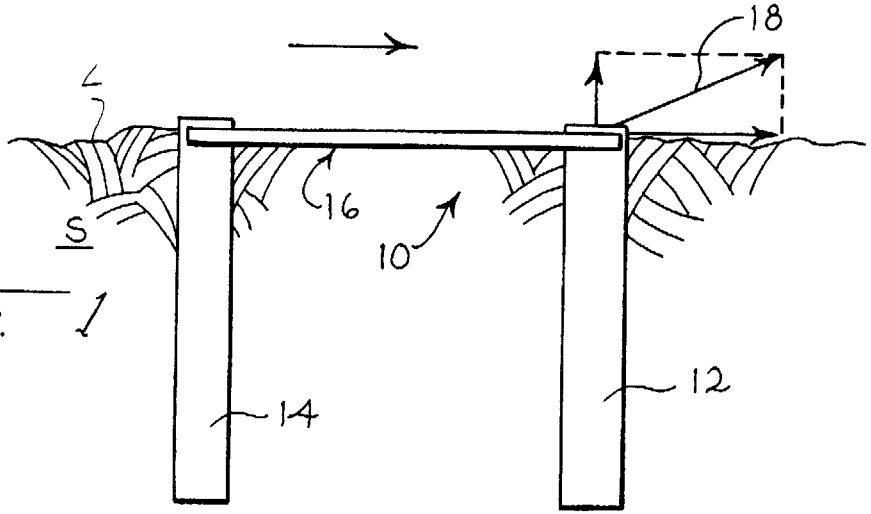
FIG. 1 is a schematic view of a ground anchor assembly that incorporates a preferred embodiment of this invention.

Turning now to the drawings, FIG. 1 shows a schematic view of a ground anchor assembly 10 that embodies the present invention. The ground anchor assembly 10 includes a first ground anchor 12, a second ground anchor 14, and a connecting element 16 coupled therebetween. The connecting element 16 is a thin strap designed to transmit tensile forces from the anchor 12 to the anchor 14. An anchor cable 18 is secured to the first ground anchor 12, and the rearward end of the anchor cable 18 is secured to a guardrail assembly as described in greater detail below.

As shown in FIG. 1, the ground anchors 12 and 14 can take the form of elongated cylinders such as tubes that are driven into the soil S such that they barely protrude above the level L of the ground. Here, it is important to recognize that the anticipated direction of motion of an impacting vehicle is in the direction of the arrow of FIG. 1, and that the first ground anchor 12 to which the cable 18 is secured is positioned downstream of the second ground anchor 14. That is, an impacting vehicle passes the second ground anchor 14 before it passes the first ground anchor 12. With respect the guardrail assembly (not shown in FIG. 1), the first ground anchor 12 is closer to a central portion of the guardrail assembly than is the second ground anchor 14.

It has been discovered that the geometry illustrated in FIG. 1 provides the important advantage that, in the event of high tensile forces on the cable 18, the connecting element 16 transmits a portion of these tensile forces to the second ground anchor 14, and thus the tensile load is shared between the ground anchors 12 and 14. Any tendency of the first ground anchor 12 to pivot about the yoke 16 and allow extraction of the anchor 12 without extraction of the anchor 14 is substantially eliminated, and the pullout resistance of the ground anchor assembly 10 is increased.

Figure 2:
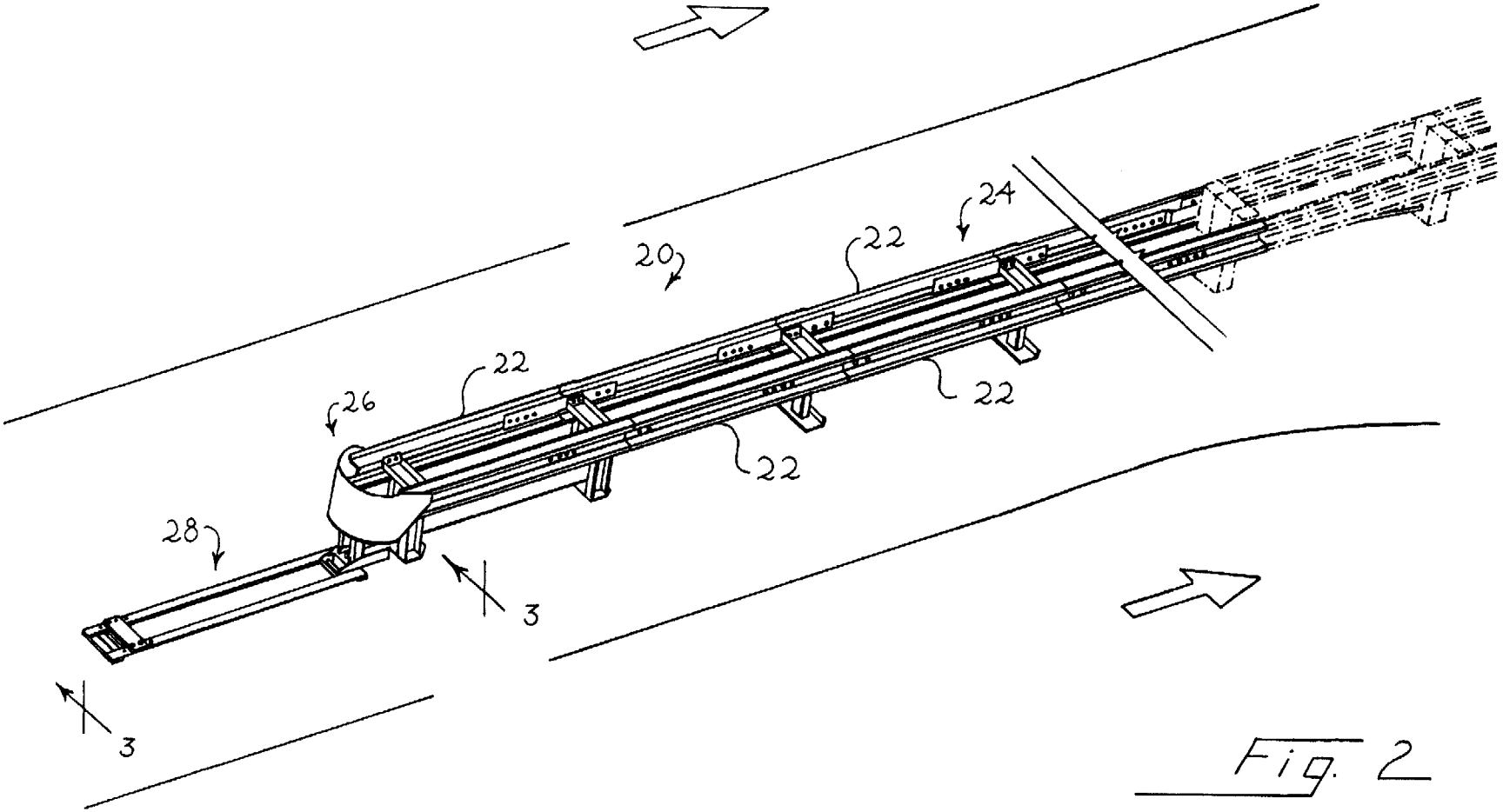
FIG. 2 is a perspective view of a guardrail assembly that incorporates a preferred embodiment of this invention.

FIG. 2 shows a perspective view of a guardrail assembly 20 that incorporates a preferred embodiment 28 of the ground anchor assembly of this invention. As shown in FIG. 2, the guardrail assembly 20 includes an array of parallel guardrails 22, and the assembly 20 includes a central portion 24 and an end portion 26. Vehicles traveling on adjacent roadways move in the directions of the arrows.

Figure 3:
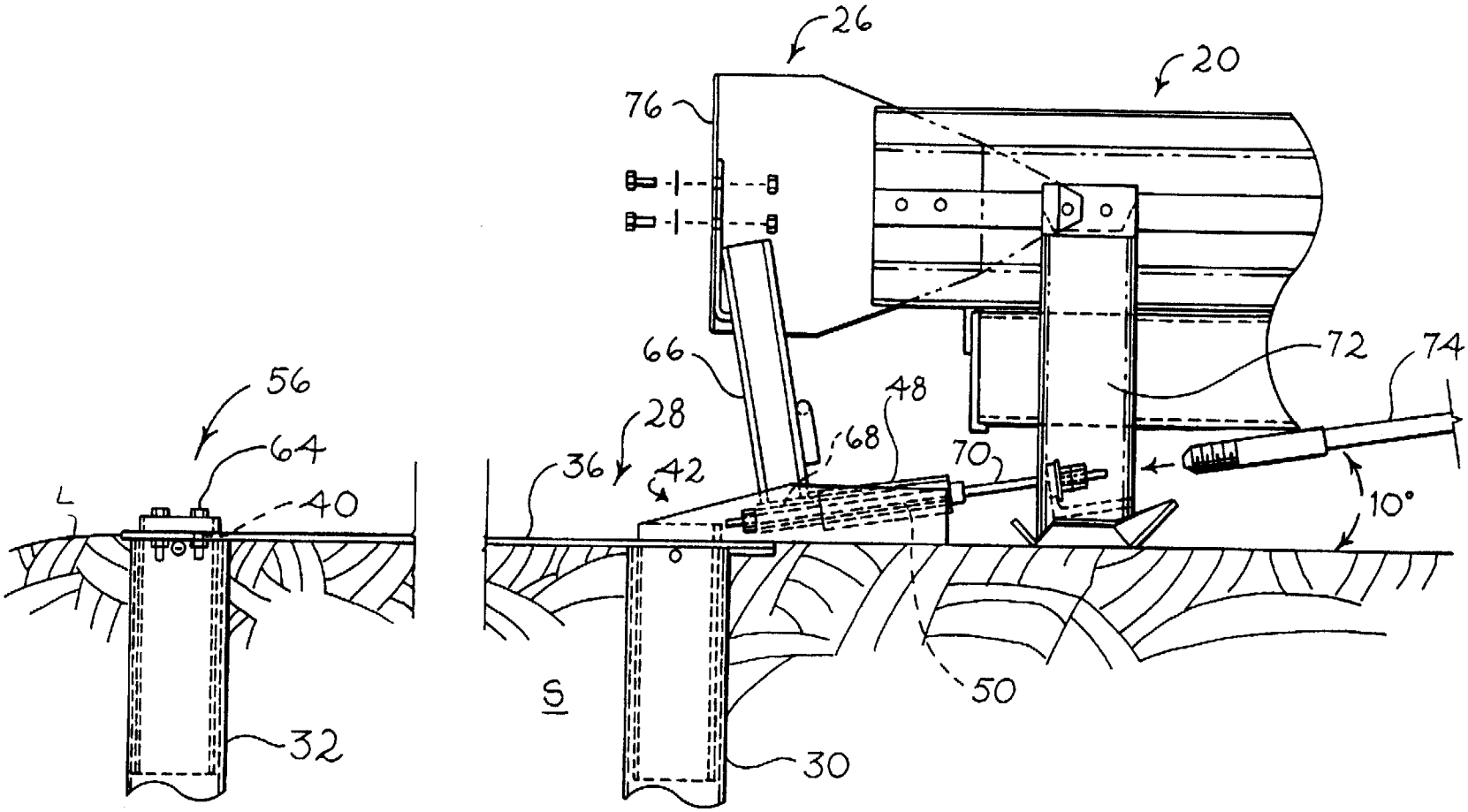
FIG. 3 is a longitudinal sectional view taken along line 3—3 of FIG. 2.
Figure 4:
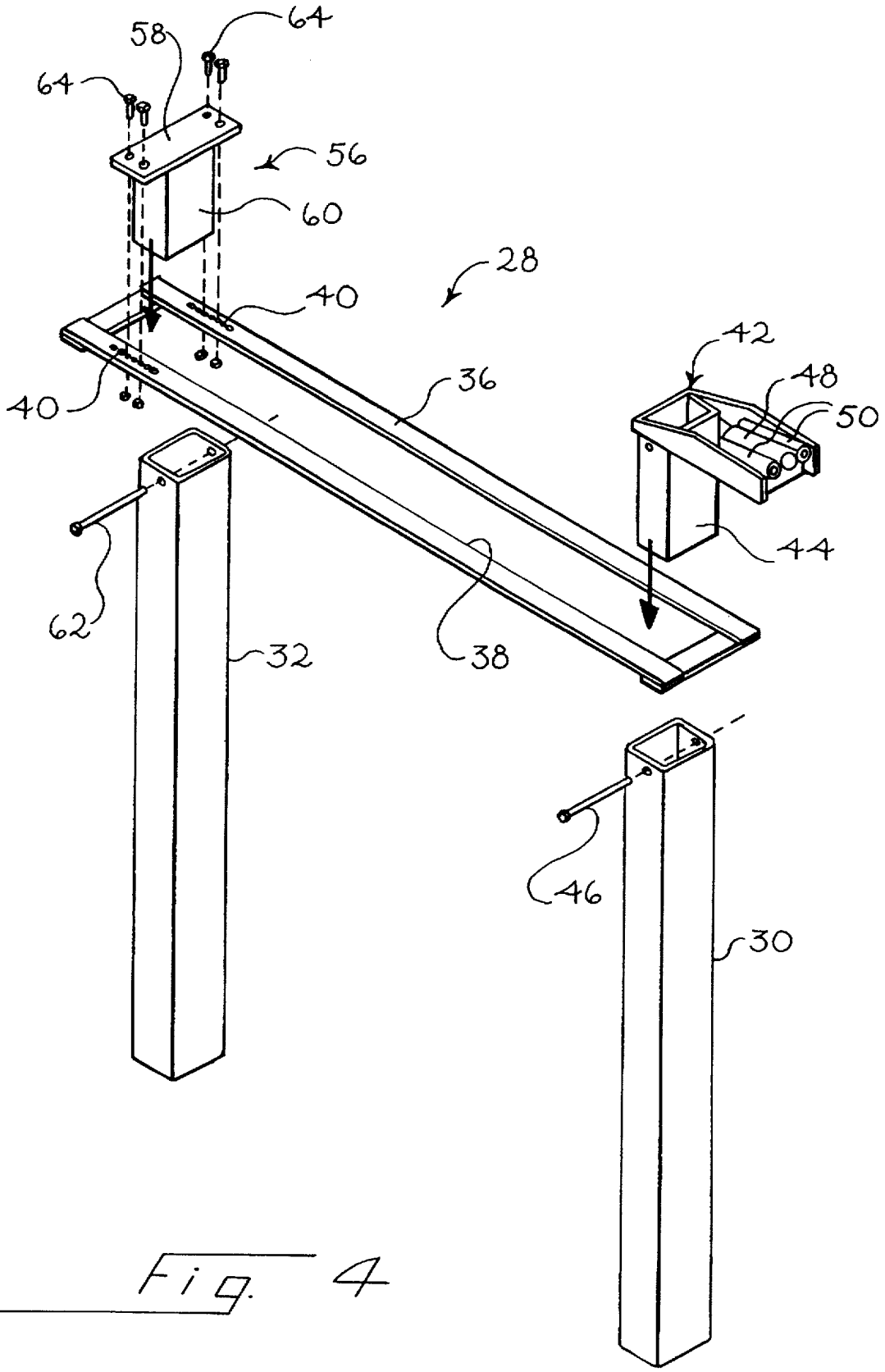
FIG. 4 is an exploded perspective view of the ground anchor assembly of the embodiment of FIGS. 2 and 3.

FIG. 3 provides more detailed information regarding the arrangement of the ground anchor assembly 28. As shown in FIG. 3, the ground anchor assembly 28 includes a first tube 30 and a second tube 32 interconnected by a connecting element 36. As best shown in FIG. 4, the connecting element 36 defines an axially extending slot 38 and an array of openings 40 on either side of the slot adjacent one end.

Still referring to FIG. 4, the ground anchor assembly 28 includes an anchor cable mounting element 42 that includes a plug 44 designed to fit within the upper end of the first tube 30 and to be secured in place by a cross bolt 46. The anchor cable mounting element 42 includes a center tube 48 designed to receive and secure the forward end of an anchor cable and two parallel side tubes 50.

The ground anchor assembly 28 also includes a forward mounting element 56 which is made up of a top plate 58 and a vertically extending plug 60. The plug 60 is designed to fit within the upper end of the second tube 32 and to be secured in place by a cross bolt 62. Bolts 64 secure the top plate 58 in position to the connecting element 36 by means of selected ones of the openings 40.

Returning to FIG. 3, the guardrail assembly 20 includes a lever arm 66 which has mounted at its lower end a pair of tubes 68 (only one shown in FIG. 3). Each of the tubes 68 is aligned with a respective one of the side tubes 50 and a pair of bolts 70 (only one shown in FIG. 3) interconnecting the forward leg 72 of the guardrail assembly 20, the side tubes 50, and the tubes 68. The upper end of the lever arm 66 is positioned adjacent a nose plate 76 situated at the forwardmost portion of the guardrail assembly 20. The anchor cable 74 is firmly secured at its forwardmost end to the anchor cable mounting element 42 by means of the center tube 48.

The ground anchor assembly 28 of FIG. 3 can be installed by driving the tubes 30, 32 into the soil S until the tops of the tubes 30, 32 are substantially at ground level L. Then the connecting element 36 is positioned around the upper ends of the tubes 30, 32 and the anchor cable mounting element 42 is installed in place in the first tube 30. Then the forward mounting element 56 is installed in the second tube 32, and the connecting element 36 is positioned snugly against the first tube 30. Then the bolts 64, are passed through aligned ones of the openings 40 and tightened to complete assembly. Once the guard rail assembly 20 and the ground anchor assembly 28 have been mounted in place, the anchor cable 74 can be secured and adjusted in place in the center tube 48, and the lever arm 66 and the bolts 70 can be installed.

As shown in FIG. 3, the connecting element 36 and the second tube 32 are situated beyond the end portion 26 of the guardrail assembly 20, and forwardly of the anchor cable 74. The connecting element 36 is situated on a horizontal line that is aligned with a vertical plane that includes the anchor cable 74. No part of the connecting element 36 or the second tube 32 or the forward mounting element 56 extends more than one inch above ground level L.

One advantage of the embodiment of FIG. 3 is that it operates as explained above in conjunction with FIG. 1 to provide excellent resistance to unintended extraction, even in the event the ground anchor assembly 28 is used in weak or saturated soil. In the event the first ground anchor begins to translate vertically in response to the vertical component of the applied tension in the anchor cable, the connecting element is placed in tension, and thus spreads a portion of the vertical component of the applied tensile load to the second ground anchor. In this way the likelihood of the first ground anchor being extracted from the soil, and thus causing the guardrail to fail, it is reduced. Furthermore, the second tube 32 and the connecting element 36 do not extend substantially above ground level L, and present substantially no interfering snagging surfaces to an impacting vehicle. Since the connecting element 36 operates in tension rather than compression, a thin, low profile construction can be used.

In order further to strengthen the ground anchor assembly 28 against pull-out forces, the anchor cable 74 is preferably oriented at a small angle with respect to the horizontal plane. In this preferred embodiment the included angle between the anchor cable 74 and the connecting element 36 is preferably more than 150 degrees, more preferably more than 165 degrees, and most preferably substantially equal to 170 degrees. This corresponds to an angle of about 10 degrees between the anchor cable 74 and a horizontal plane.

Remaining portions of the guard rail assembly 20 downstream of the ground anchor assembly 28 can be made in the manner described in above-referenced U.S. Pat. No. 5,022,782, assigned to the assignee of the present invention. This patent clearly explains the operation of the lever arm 66.

Figure 7:
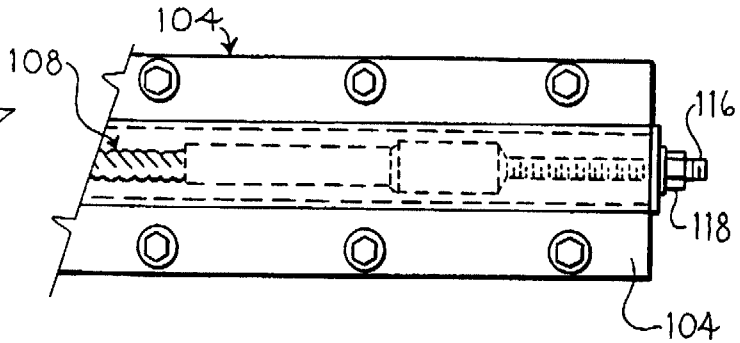
FIG. 7 is a fragmentary side view taken along line 7—7 of FIG. 6.
Figure 5:
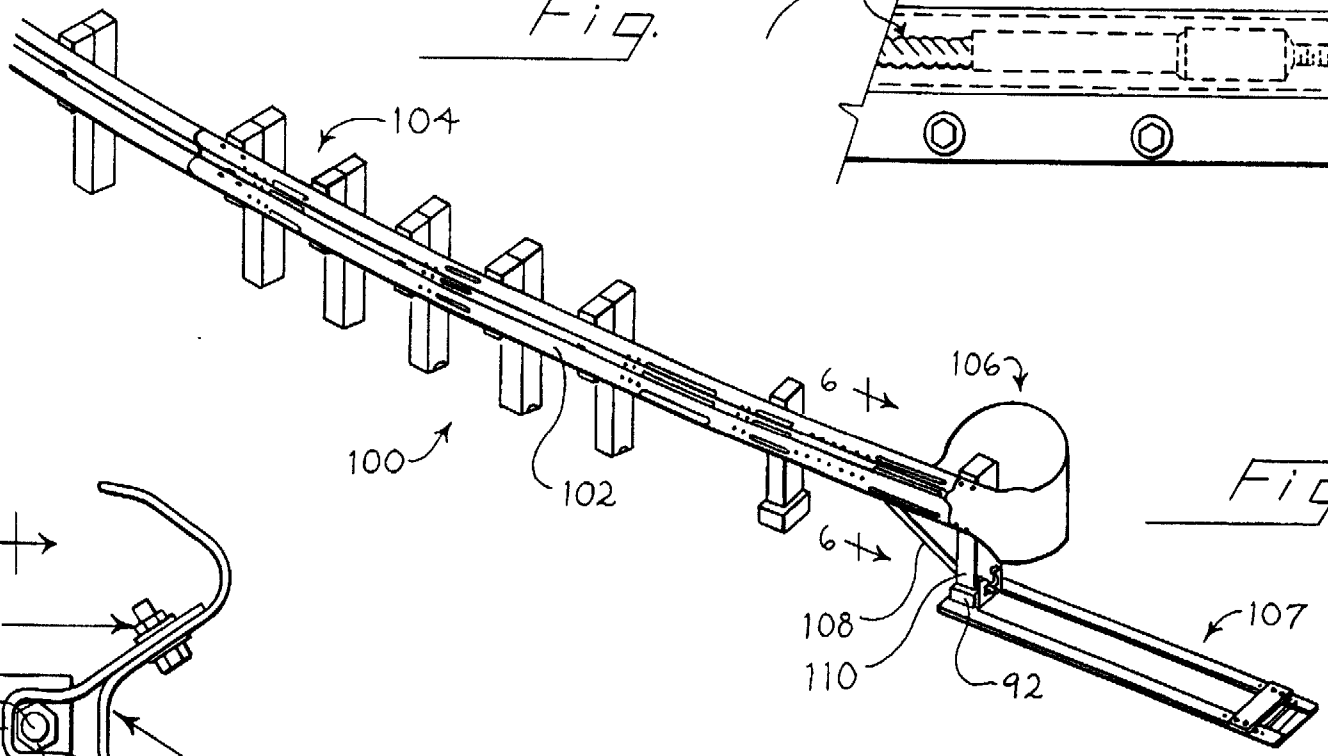
FIG. 5 is a perspective view of another guardrail assembly that incorporates a preferred embodiment of this invention.
Figure 6:
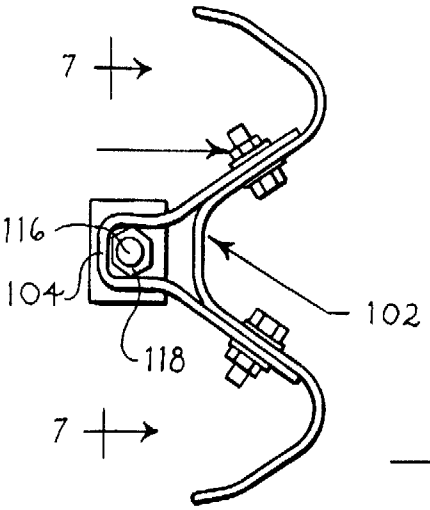
FIG. 6 is a cross-sectional view taken along line 6—6 of FIG. 5.
Figure 9:
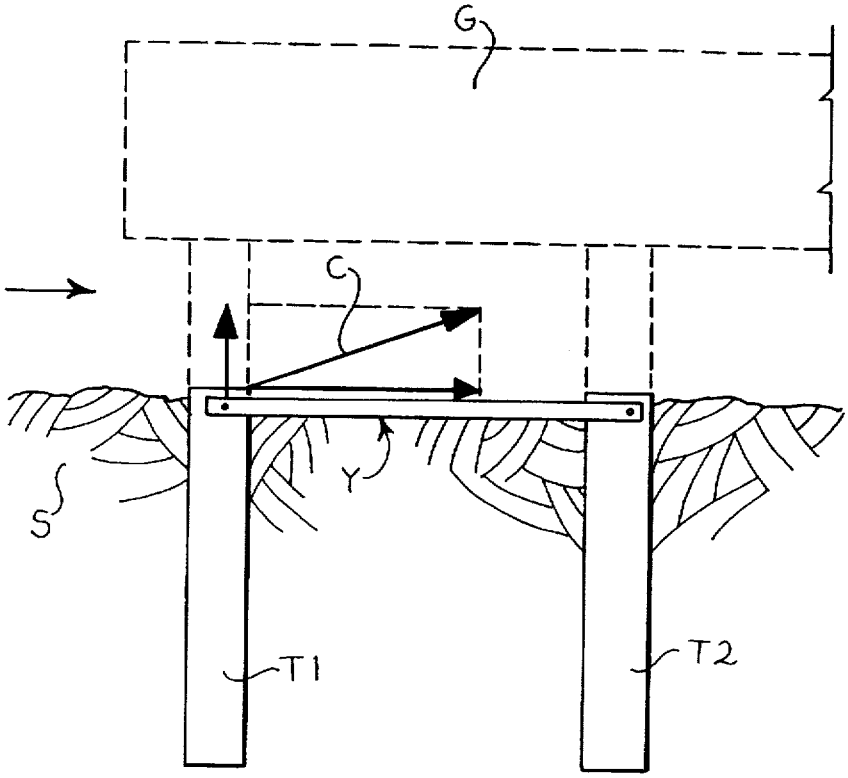
Fig. 9 PRIOR ART
FIGS. 9 and 10 are schematic representations of prior-art ground anchor assemblies.
Figure 10:
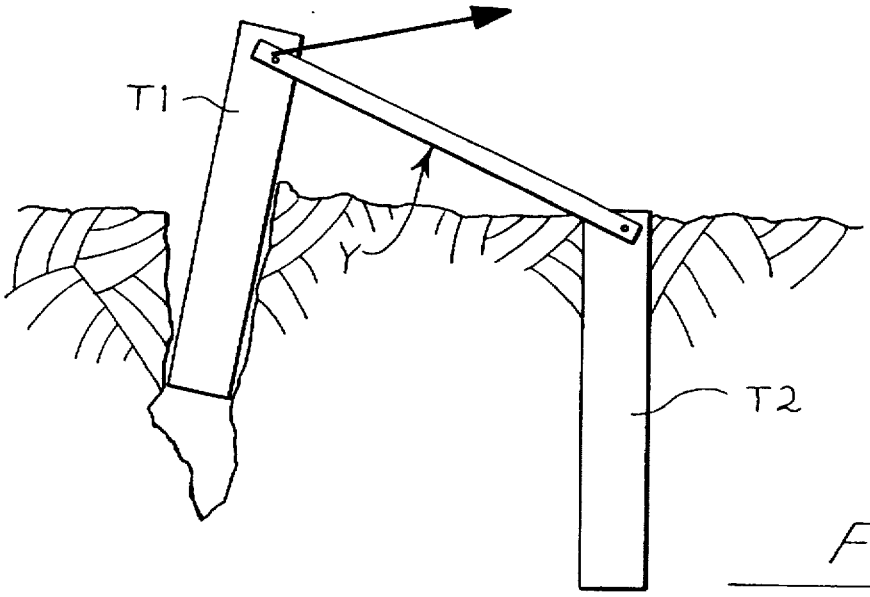
Fig. 10 PRIOR ART

FIGS. 5 through 7 relate to a guard rail assembly 100 that incorporates the preferred embodiment described above of the ground anchor assembly. As shown in FIG. 5, the guard rail assembly 100 includes a guardrail 102 having a central portion 104 and end portion 106. A ground anchor assembly 107 is provided which is generally similar to the ground anchor assembly 28 described above, except the anchor cable mounting element 42 simply receives the forward end of the anchor cable 108, without using the lever arm arrangement described above. In this case, the rearward ground anchor of the ground anchor assembly 107 supports both the forward end of the anchor cable 108 and the forward leg 110 of the guardrail assembly 100.

As shown in FIGS. 6 and 7, the rearward end of the anchor cable 108 is secured to a guardrail 102 by means of a housing 104 that is bolted to the guardrail 102. The housing 104 defines a central region that receives a screw 116 fixedly secured to the rearward end of the cable 108. A nut 118 engages the screw 116 and bears on the housing 114 to tension the cable 108. The rearward attachment of the anchor cable 108, and in fact all elements of the guardrail assembly 100 rearwardly disposed of the ground anchor assembly 108, are conventional and well known to those skilled in the art.

Figure 8:
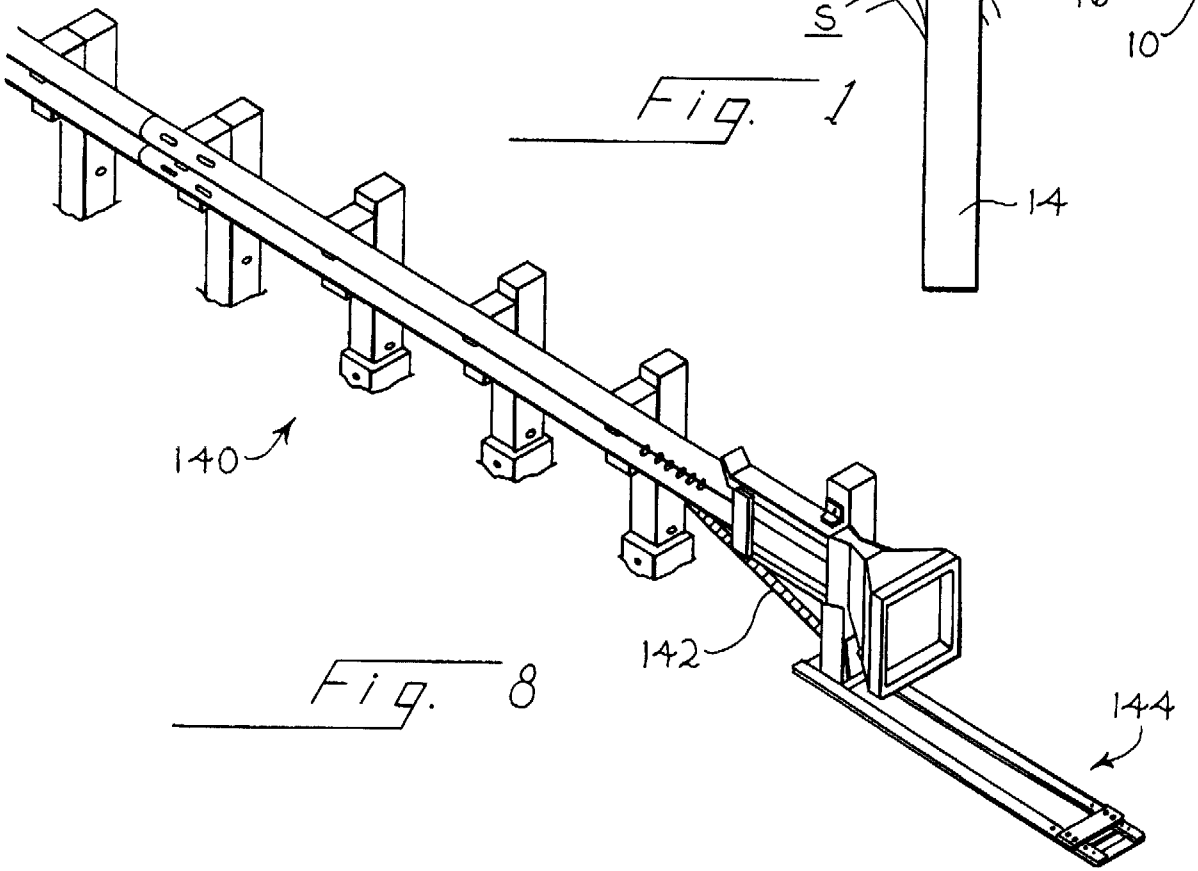
FIG. 8 is a perspective view of a third guardrail assembly that incorporates a presently preferred embodiment of this invention.

FIG. 8 shows another guardrail assembly 140 that includes an anchor cable 142 and a ground anchor assembly 144. The ground anchor assembly 144 is substantially identical to the ground anchor assembly 108 described above. FIG. 8 discloses another type of prior-art ground rail assembly 140 suitable for use with the improved ground anchor assembly of this invention.

As should be apparent from the foregoing description, the ground anchor assembly of this invention can be adapted for use with a wide variety of guardrails. In the embodiments illustrated above, the ground anchor assembly extends forwardly of the guardrail assembly. This is not required in all applications, and if desired both ground anchors of the ground anchor assembly can be disposed within the region occupied by the guardrail. Also, this invention is not limited to use of the forward end of a guardrail assembly, but may also find application at the rearward end of the assembly, or at intermediate portions. If desired, more than two ground anchors may be used.

A wide variety of materials can be adapted for use with this invention. In one preferred form, the ground anchors can take the form of mild steel structural tubing and the connecting element may be welded from mild steel linear elements. Similarly, the forward and rearward mounting elements can be welded from mild steel elements. Dimensions will vary depending upon the intended application, but in one preferred embodiment the following dimensions have been found suitable. The ground anchors can be formed of tubing having a length of 78 inch (200 cm), a wall thickness of 3/16 inch (0.5 cm), and a width and height of 6 inch by 8 inch (15 cm×20 cm). The connecting element may be formed of strips of mild steel having a thickness of 3/8 inch (1 cm), a width of 3 inch (8 cm), and an overall length of 90 inch (230 cm). The mounting elements can be welded of mild steel having a thickness of 1/4 inch (0.6 cm) in the region of the plugs 44, 60, and smaller thicknesses down to 1/8 inch (0.3 cm) for the remaining components.

Of course, a wide range of changes and modifications can be made to the preferred embodiments described above. For example, the first and second ground anchors may be implemented as timber posts, I-beam posts, posts or anchors made of composite materials (including but not limited to fiberglass or carbon fiber composites), or concrete piles formed around an attachment to which the connecting element may be affixed. Furthermore, the connecting element does not have to be formed as a frame as shown, but can instead take any suitable structural form adequate to transmit the desired level of tensile loading. The anchor cable can take the force of a chain, strap, or other tension member, and the term "tension member" will be used broadly for all such devices.

As another example, this invention can readily be adapted for use with bi-directional guardrails, of the type suited for use between two lanes of traffic traveling in opposite directions.

The foregoing detailed description has described only a few of the many forms that the present invention can take. For this reason, it is intended that the foregoing detailed description be regarded as illustrative and not as limiting. It is only the following claims, including all equivalents, that are intended to define the scope of this invention.

I claim:

1. In a guardrail assembly of the type comprising an array of interconnected guardrails and a tension member secured to the guardrail assembly, wherein the guardrail assembly comprises an end portion and a central portion, and wherein the central portion is situated downstream of the end portion in an anticipated direction of motion of an impacting vehicle, an improved ground anchor assembly comprising:

first and second spaced ground anchors; and a connecting element interconnected between the first and second ground anchors;

said tension member connected to the ground anchor assembly adjacent the first ground anchor;

said second ground anchor being situated farther from the central portion of the guardrail assembly than the first ground anchor.

2. The invention of claim 1 wherein said connecting element extends farther from the central portion of the guardrail assembly than does the tension member.

3. The invention of claim 1 wherein the connecting element extends along a substantially horizontal line, said line situated in a vertical plane that includes the tension member.

4. The invention of claim 1 wherein each of the ground anchors comprises a respective post buried in soil adjacent the guardrail assembly.

5. The invention of claim 4 wherein the second ground anchor is situated beyond the end portion of the guardrail assembly.

6. The invention of claim 5 wherein the connecting element extends beyond the end portion of the guardrail.

7. The invention of claim 6 wherein the connecting element is exposed at an upper surface of the soil.

8. The invention of claim 6 wherein no part of the second ground anchor extends more than about one inch above the upper surface of the soil.

9. The invention of claim 8 wherein no part of the connecting element extends more than about one inch above the upper surface of the soil.

10. The invention of claim 1 wherein the tension member defines an included angle of greater than 150° with the connecting element.

11. The invention of claim 10 wherein the included angle is greater than 165°.

12. The invention of claim 1 wherein the connecting element comprises a frame that forms a longitudinally-extending slot, wherein the first and second ground anchors pass through the slot, wherein the frame transmits tensile forces between the ground anchors, and wherein at least one of the ground anchors is free to slide in the slot.

13. The invention of claim 1 wherein the end portion comprises a terminal portion of the guardrail assembly, and wherein the central portion is spaced rearwardly of the end portion with respect to a vehicle movement direction of vehicles on an adjacent roadway.

* * * * *